US012654829B2

(12) United States Patent
Sachs

(10) Patent No.: US 12,654,829 B2
(45) Date of Patent: Jun. 16, 2026

(54) BOAT SAIL

(71) Applicant: Christophe Sachs, Garches (FR)

(72) Inventor: Christophe Sachs, Garches (FR)

( * ) Notice: Subject to any disclaimer, the term of this patent is extended or adjusted under 35 U.S.C. 154(b) by 577 days.

(21) Appl. No.: 18/265,937

(22) PCT Filed: Dec. 6, 2021

(86) PCT No.: PCT/FR2021/052216
§ 371 (c)(1),
(2) Date: Dec. 26, 2023

(87) PCT Pub. No.: WO2022/123161
PCT Pub. Date: Jun. 16, 2022

(65) Prior Publication Data

US 2024/0317375 A1 Sep. 26, 2024

(30) Foreign Application Priority Data

Dec. 7, 2020 (FR) ..... 2012777

(51) Int. Cl.
*B63H 9/067* (2020.01)

(52) U.S. Cl.
CPC ..... *B63H 9/0678* (2020.02)

(58) Field of Classification Search
CPC ..... B63H 9/0678; B63H 9/06; B63H 9/067
See application file for complete search history.

(56) References Cited

U.S. PATENT DOCUMENTS

| | | | | |
|---|---|---|---|---|
| 4,702,190 | A * | 10/1987 | Conrad | B63H 9/067 114/102.31 |
| 6,237,521 | B1 * | 5/2001 | Muller | B63H 9/067 114/39.21 |
| 2003/0213421 | A1 | 11/2003 | Baudet | |
| 2013/0220195 | A1 * | 8/2013 | Sjostedt | B32B 5/028 156/60 |
| 2019/0233056 | A1 * | 8/2019 | Dane | B63B 15/00 |
| 2020/0247515 | A1 * | 8/2020 | Jenkins | B63H 9/069 |

FOREIGN PATENT DOCUMENTS

| | | | | |
|---|---|---|---|---|
| CN | 106741782 A * | 5/2017 | | G05D 1/0206 |
| FR | 2607104 | 5/1988 | | |
| GB | 912909 | 12/1962 | | |

OTHER PUBLICATIONS

English translation of Wu CN-106741782-A (Year: 2017).*
International Search Report dated Mar. 15, 2022.
International searching authority dated.

* cited by examiner

*Primary Examiner* — Evan P Dzierzynski
(74) *Attorney, Agent, or Firm* — IPSILON USA, LLP

(57) ABSTRACT

A boat sail of the membrane sail type includes two transparent plastic sheets between which are laid at least one network of reinforcing fibers, photovoltaic films and battens, featuring at least one zone free of battens and photovoltaic films, in the shape of a curvilinear triangle.

5 Claims, 3 Drawing Sheets

BOAT SAIL

RELATED APPLICATION:

This application is a National Phase of PCT/FR2021/052216 filed on Dec. 6, 2021, which claims the benefit of priority from French Patent Application No. 20 12777, filed on Dec. 7, 2020, the entirety of which are incorporated by reference.

FILED OF THE INVENTION:

This invention relates to a boat sail of the membrane sail type, fitted with solar panels and battens.

DESCRIPTION OF RELATED ART

EP2439133 describes a membrane sail consisting of two sheets of plastic bonded together following the interposition of threads coated with heat-curing adhesive.

There are membrane sails featuring a fiber network radiating from one corner of the sail between two plastic sheets. There are also membrane sails featuring several fiber networks, each radiating from a corner of the sail, so that the fibers of the different networks crisscross each other.

Patent FR2676984 describes, for a headsail, battens parallel to the sail support stay to make it easier to furl the sail around the stay.

There are membrane sails featuring solar panels between their two transparent plastic sheets to supply power to the cockpit. These panels are very thin photovoltaic films.

OBJECTS AND SUMMARY:

One of the aims of the invention is to propose a sail adapted to provide flexibility and resistance in high winds.

Another aim of the invention is to propose a sail adapted to offer flexibility and resistance to photovoltaic films, especially to prevent them from folding when the sail is furled, on the stay for a headsail, or on the mast for a mainsail.

A further aim of the invention is to enhance the sail's strength using biomimicry.

The invention relates to a boat sail, of the membrane sail type, consisting of two sheets of transparent plastic material between which are laid: at least one network of reinforcing fibers, photovoltaic films and battens, the sail being characterized in that it features at least one zone free of battens and photovoltaic films, in the shape of a curvilinear triangle, one side of which is located on the aft edge of the sail and the vertex, opposite said side, of which is located on the leading edge of the sail.

In one embodiment, the side of the curvilinear triangle of the zone is located on the edge, vertical at rest, of the sail, between the bottom point of the edge and around one-third of the height of the vertical edge, and the vertex is located on the leading edge of the sail connected to the stay, at a point approximately one-third of the height of the stay from its bottom attachment point.

In one embodiment, the sail features several curvilinear triangles spread over the height of the mainsail, the sides of which are located on the aft edge of the mainsail and the vertices on the leading edge attached to the mast.

In one embodiment, the sail features a further network of reinforcing fibers, arranged like the network of veins on a dragonfly wing.

In one embodiment, the sail is attached to an inflatable stay to ensure furling of the sail.

Figure 1:
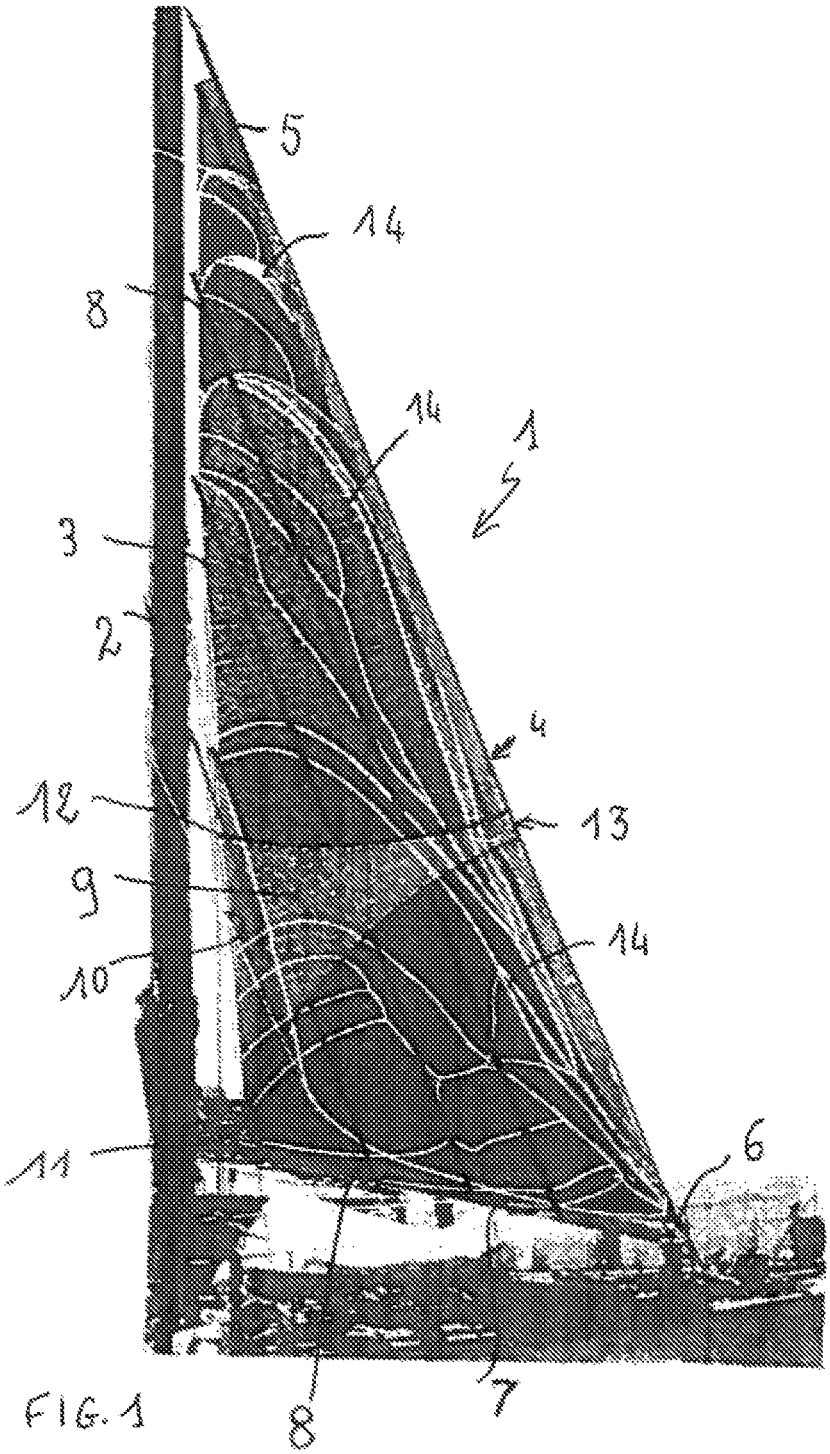
FIG. 1 shows a triangular headsail according to the invention, which can be furled on the stay.

DETAILED DESCRIPTION:

In FIG. 1, the headsail (1) of a boat is triangular, it is supported by a mast (2), along which it has a near-vertical edge (3) at rest. The leading edge (4) of the sail (1) is connected to the stay (5), which has a bottom point (6) for attachment to the boat. The third edge (7) of the sail is near-horizontal. The sail (1) is a membrane sail, consisting of two transparent plastic sheets between which are laid at least one network of reinforcing fibers (not shown), photovoltaic films (not shown) and battens (8) parallel to the stay (5).

In accordance with the invention, the sail (1) features a zone (9) free of battens (8) and photovoltaic films. This zone (9) takes the form of a curvilinear triangle, one side (10) of which is located along the edge (3), vertical at rest, of the sail (1). The side (10) of the curvilinear triangle of this zone (9) is located between the bottom point (11) of the vertical edge (3) of the sail (1) and a point (12) approximately one-third of the height of the vertical edge (3) of the sail (1). The vertex (13) of the curvilinear triangle in this zone (9), on the opposite side (10), is located on the leading edge (4) of the sail (1) connected to the stay (5), at a point approximately one-third the height of the stay (5) from its bottom attachment point (6). Both sides of the curvilinear triangle of this zone (9), located between the vertex (13) and the side (10), are curved towards the inside of the curvilinear triangle.

That zone (9) is free of photovoltaic films, and battens (8) lie outside the zone (9) but not within. That zone (9) makes it easier to initially position the sail (1) on the stay. In high winds, that zone (9) acts as a torsion damper.

In a particular embodiment of the invention, the stay (5) is inflatable when the sail (1) is furled. During furling, that zone (9) ensures flexibility and resistance to the photovoltaic films of the other parts of the sail, to prevent them from folding.

Another embodiment of the invention is that the sail (1) features a further network of reinforcing fibers (14) laid out between the two plastic sheets of the membrane sail. This further network of reinforcing fibers (14) reproduces, by biomimicry, the network of veins of the dragonfly wing, with the bottom point (6) for attaching the stay (5) to the boat representing the point at which the wing is attached to the dragonfly's body. Reinforcing fibers (14) have substantially curvilinear paths, thus enhancing their interaction with the network, or networks, of fibers radiating from a corner, or corners, of the sail. Biomimicry is further emphasized by the fact that the vertex (13) of the curvilinear triangle in that zone (9) corresponds on the dragonfly wing to the articulation point of the two longitudinal halves of the wing at the dragonfly's last molt.

Figure 2:
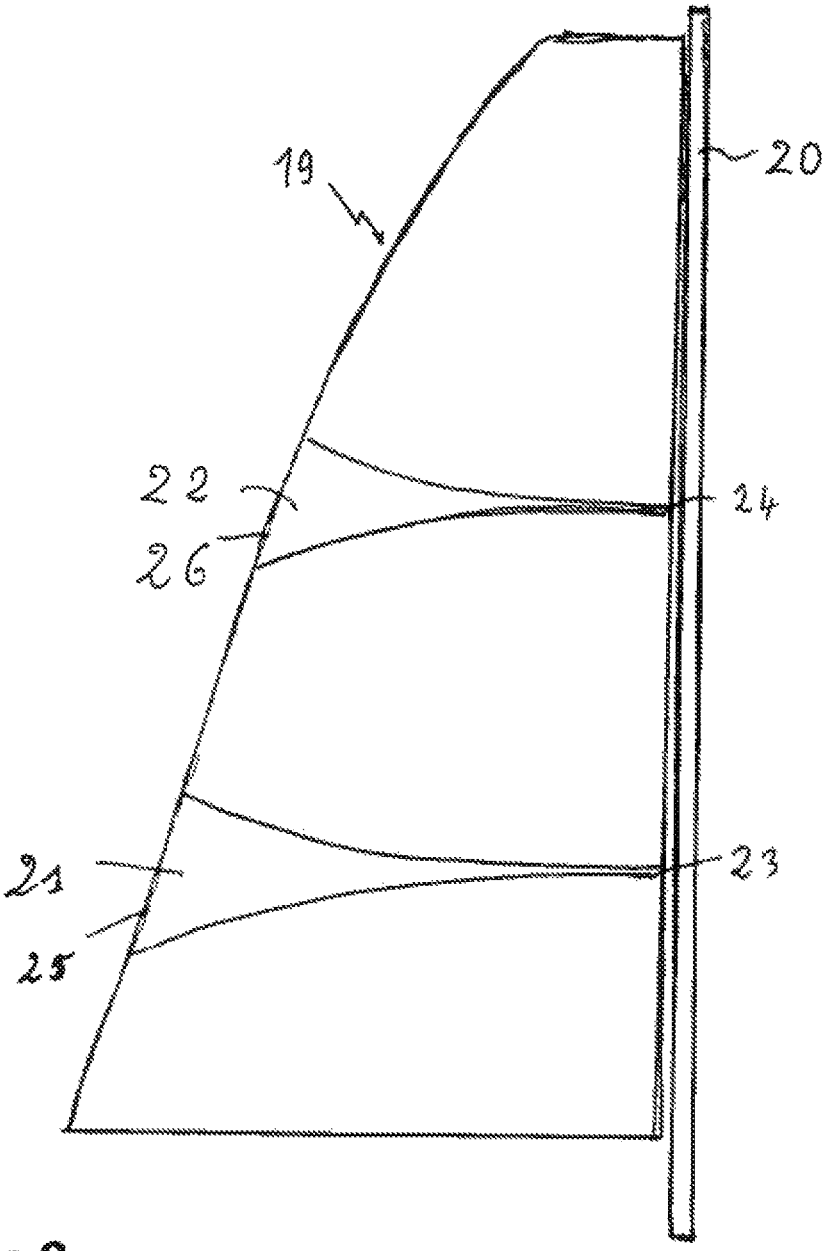
FIG. 2 shows a mainsail which can be furled on the mast.

The example shown in FIG. 2 illustrates some aspects of the invention in the case of a mainsail (19) which can be furled onto a mast (20). Battens and photovoltaic films are not shown. In this example, the mainsail is made up of two curvilinear triangles (21, 22), spread over the height of the mainsail (19). Each of these curvilinear triangles (21, 22) has vertices (23, 24) on the leading edge of the mainsail (19), and a side (25, 26), opposite vertices (23, 24), on the aft edge of the mainsail (19).

In the case of a mainsail (19) that can be furled onto the mast (20), battens substantially parallel to the mast (20) are laid in the mainsail (19) and discontinued where curvilinear triangles (21, 22) are located. This arrangement makes it easier to position the mainsail (19) on the mast (20).

Figure 3:
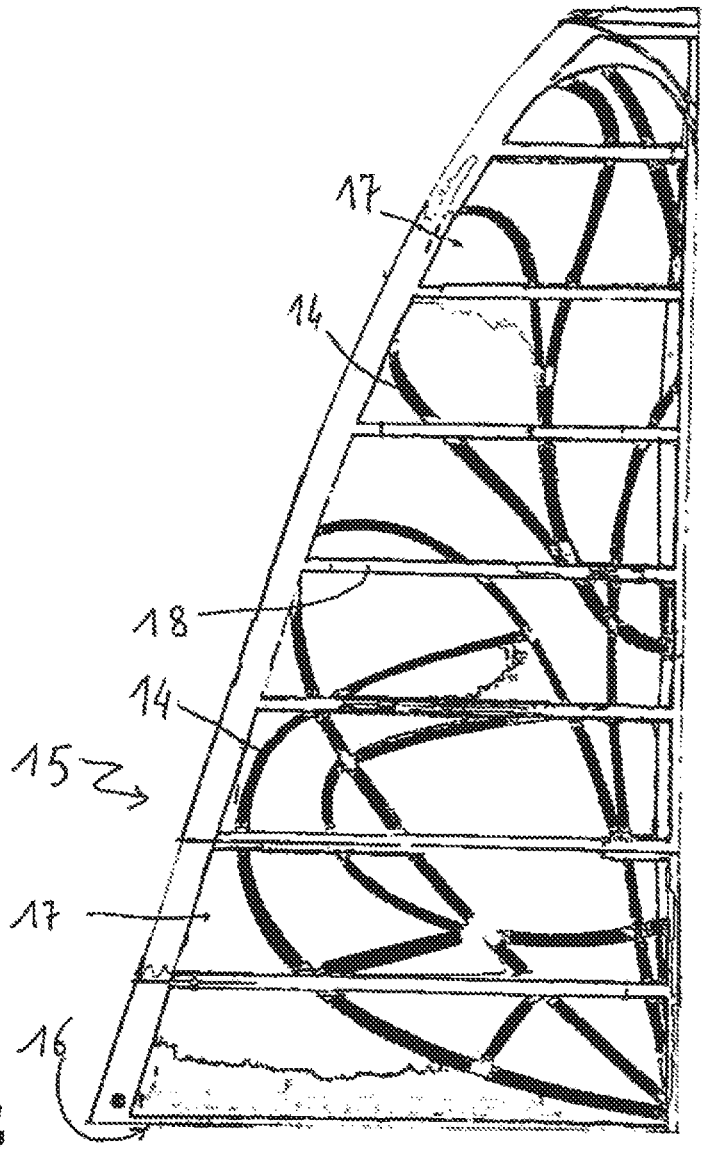
FIG. 3 shows a substantially triangular sail, which can be furled on the boom.

Embodiment shown in FIG. 3 illustrates some aspects of the invention in the case of a mainsail (15) which can be furled on a boom (16). Standard reinforcing fiber networks laid between two transparent plastic sheets of the membrane sail, are not shown. Photovoltaic films (17) are formed as two-sided quadrilaterals parallel to the boom (16), separated by strips (18) connecting the membrane sail sheets. The strips (18) may contain battens. The further network of reinforcing fibers (14) forms an attachment pattern for the sail sheets. The photovoltaic films (17) are laser-cut along fibers (14) of the further network to ensure bonding of the two membrane sail sheets through films (17).

The photovoltaic films can be laid out over virtually the entire sail surface apart from the connecting strips between the two membrane sail sheets.

The photovoltaic films (17) are connected in series or in parallel to supply power to the boat. They are translucent and allow light to pass through to the films laid out in sails parallel to the sail (15) or concealed by the sail (15).

The invention claimed is:

1. A boat sail in the form of a membrane sail comprises:

two transparent plastic sheets between which are laid at least one network of reinforcing fibers, photovoltaic films and battens, wherein said boat sail features at least one zone free of battens and photovoltaic films, in the shape of a curvilinear triangle, one side of which is located on the aft edge of the sail and the vertex of which, opposite the said side, is located on the leading edge of the sail.

2. The sail according to claim 1, in the form of a headsail, wherein the side of the curvilinear triangle of the zone is located on the edge, vertical at rest, of the sail, between the bottom point of the edge and approximately one third of the height of the vertical edge, and the vertex is located on leading edge of the sail connected to the stay, at a point approximately one third of the height of the stay from its bottom attachment point.

3. A sail according to claim 2, the sail is attached to an inflatable stay for furling the sail.

4. The sail according to claim 1, in the form of a mainsail, wherein said sail features several curvilinear triangles spread over the height of the mainsail, the sides of which are located on the aft edge of the mainsail and vertices on the leading edge attached to the mast.

5. The sail according to claim 1, wherein said sail has a further network of reinforcing fibers, arranged in the manner of the network of veins of a dragonfly wing.

* * * * *